US008459272B2

(12) United States Patent
Karles et al.

(10) Patent No.: US 8,459,272 B2
(45) Date of Patent: Jun. 11, 2013

(54) CIGARETTES AND FILTER SUBASSEMBLIES WITH SQUEEZABLE FLAVOR CAPSULE AND METHODS OF MANUFACTURE

(75) Inventors: Georgios D. Karles, Richmond, VA (US); Jeffrey Allen, Midlothian, VA (US); Jose Nepomuceno, Beaverdam, VA (US)

(73) Assignee: Philip Morris USA Inc., Richmond, VA (US)

( * ) Notice: Subject to any disclaimer, the term of this patent is extended or adjusted under 35 U.S.C. 154(b) by 199 days.

(21) Appl. No.: 12/987,728

(22) Filed: Jan. 10, 2011

(65) Prior Publication Data

US 2011/0100387 A1 May 5, 2011

Related U.S. Application Data

(62) Division of application No. 11/415,107, filed on May 2, 2006, now Pat. No. 7,878,962.

(60) Provisional application No. 60/676,937, filed on May 3, 2005.

(51) Int. Cl.
*A24D 3/06* (2006.01)

(52) U.S. Cl.
USPC ..... 131/337; 131/344; 131/345; 131/341

(58) Field of Classification Search
None
See application file for complete search history.

(56) References Cited

U.S. PATENT DOCUMENTS

| | | | |
|---|---|---|---|
| 2,755,206 | A | 7/1956 | Statia, Sr. |
| 3,339,558 | A | 9/1967 | Waterbury |
| 3,366,121 | A | 1/1968 | Carty |
| 3,428,049 | A | 2/1969 | Leake et al. |
| 3,547,130 | A | 12/1970 | Harlow et al. |
| 3,575,180 | A | 4/1971 | Carty |

(Continued)

FOREIGN PATENT DOCUMENTS

| | | | |
|---|---|---|---|
| CN | 2193654 | Y | 4/1995 |
| DE | 1243072 | A | 6/1967 |

(Continued)

OTHER PUBLICATIONS

International Search Report and Written Opinion mailed Aug. 30, 2006 for PCT/IB2006/001840.

(Continued)

*Primary Examiner* — Michael J Felton
(74) *Attorney, Agent, or Firm* — Buchanan Ingersoll & Rooney PC

(57) ABSTRACT

Improved delivery of additive materials to cigarettes is provided through the use of one or more capsules containing additive materials, such as flavor components, in the filter section of a cigarette. The capsule or capsules are provided between first and second absorbent members and the capsules are subjected to an external force, such as squeezing, by a smoker prior to or during smoking of the cigarette in order to release at least a portion of the additive material and expose the additive material to mainstream smoke passing through the filter. The capsules provide a barrier between the additive materials and other cigarettes components, such as sorbents or filter materials, in order to reduce additive material migration into the other cigarette components prior to desired use. An outer cover which is impermeable to the fluid within the capsules is provided about the capsule or capsules and the first and second absorbent members.

8 Claims, 5 Drawing Sheets

U.S. PATENT DOCUMENTS

| | | | | |
|---|---|---|---|---|
| 3,599,646 | A | | 8/1971 | Berger et al. |
| 3,635,226 | A | | 1/1972 | Horsewell et al. |
| 3,847,064 | A | | 11/1974 | Berger |
| 3,916,914 | A | | 11/1975 | Brooks et al. |
| 3,991,773 | A | | 11/1976 | Walker |
| 4,064,791 | A | | 12/1977 | Berger |
| 4,182,743 | A | | 1/1980 | Rainer et al. |
| 4,675,064 | A | | 6/1987 | Berger |
| 4,693,265 | A | | 9/1987 | Norman |
| 4,715,390 | A | | 12/1987 | Nichols et al. |
| 4,807,647 | A | | 2/1989 | Hayes |
| 4,869,275 | A | | 9/1989 | Berger |
| 4,889,144 | A | | 12/1989 | Tateno et al. |
| 4,920,990 | A | | 5/1990 | Lawrence et al. |
| 5,109,876 | A | | 5/1992 | Hayden et al. |
| 5,115,823 | A | * | 5/1992 | Keritsis ..... 131/336 |
| 5,186,185 | A | | 2/1993 | Mashiko et al. |
| 5,322,075 | A | | 6/1994 | Deevi et al. |
| 5,356,704 | A | | 10/1994 | Phillips et al. |
| 5,360,023 | A | | 11/1994 | Blakley et al. |
| 5,465,739 | A | | 11/1995 | Perfetti et al. |
| 5,499,636 | A | | 3/1996 | Baggett, Jr. et al. |
| 5,591,368 | A | | 1/1997 | Fleischhauer et al. |
| 5,662,126 | A | | 9/1997 | Charlton et al. |
| 5,666,976 | A | | 9/1997 | Adams et al. |
| 5,692,525 | A | | 12/1997 | Counts et al. |
| 5,692,526 | A | | 12/1997 | Adams et al. |
| 5,787,902 | A | | 8/1998 | Shepherd et al. |
| 5,915,387 | A | | 6/1999 | Baggett, Jr. et al. |
| 5,934,289 | A | | 8/1999 | Watkins et al. |
| 5,988,176 | A | | 11/1999 | Baggett, Jr. et al. |
| 6,026,820 | A | | 2/2000 | Baggett, Jr. et al. |
| 6,041,790 | A | | 3/2000 | Smith et al. |
| 6,053,176 | A | | 4/2000 | Adams et al. |
| 6,079,418 | A | | 6/2000 | Russo |
| 6,209,547 | B1 | | 4/2001 | Koller et al. |
| 6,595,218 | B1 | | 7/2003 | Koller et al. |
| 6,761,174 | B2 | * | 7/2004 | Jupe et al. ..... 131/335 |
| 7,115,085 | B2 | | 10/2006 | Deal |
| 7,836,895 | B2 | | 11/2010 | Dube et al. |
| 7,856,990 | B2 | | 12/2010 | Crooks et al. |
| 7,878,962 | B2 | | 2/2011 | Karles et al. |

FOREIGN PATENT DOCUMENTS

| | | | |
|---|---|---|---|
| EP | 0276021 | A2 | 7/1988 |
| EP | 0292949 | A2 | 11/1988 |
| EP | 0452906 | A2 | 10/1991 |
| EP | 0491952 | A1 | 7/1992 |
| FR | 2122014 | A | 8/1972 |
| JP | 2000-14377 | A | 1/2000 |
| NL | 1017166 | | 7/2002 |
| WO | WO03/009711 | A1 | 2/2003 |

OTHER PUBLICATIONS

International Preliminary Report on Patentability mailed Nov. 15, 2007 for PCT/IB2006/001840.

Official Action dated Sep. 6, 2010 for Chinese Utility Model Appln. No. 200680020509.6.

* cited by examiner

CIGARETTES AND FILTER SUBASSEMBLIES WITH SQUEEZABLE FLAVOR CAPSULE AND METHODS OF MANUFACTURE

This application is a divisional of U.S. patent application Ser. No. 11/415,107, entitled Cigarettes And Filter Subassemblies With Squeezable Flavor Capsule And Methods Of Manufacture, filed on May 2, 2006, now U.S. Pat. No. 7,878,962 which claims priority under 35 U.S.C. §119(e) to U.S. Provisional Application No. 60/676,937, entitled Cigarettes And Filter Subassemblies With Squeezable Flavor Capsule And Methods Of Manufacture, filed on May 3, 2005, the entire content of each is hereby incorporated reference.

FIELD OF THE INVENTION

The present invention relates to cigarettes and filter subassemblies for use with cigarettes as well as to methods of manufacturing cigarettes and cigarette filters.

BACKGROUND

Sorbents incorporated in some traditional cigarettes have not satisfactorily provided the desired taste effect to the smoker. Due to volatility of added flavorants, the uniformity of flavored cigarettes has not been totally satisfactory. Thus, there is interest in improved articles and methods of delivering additive materials or agents such as flavorings to cigarettes. Irreversible loss of volatile flavors may also occur following flavor migration to sorbents used in cigarette filters to remove targeted gas phase constituents. These sorbents also adsorb flavors delivered in mainstream smoke thus reducing the taste and sensorial character/acceptability of cigarettes.

SUMMARY

In a first embodiment, a cigarette filter subassembly comprises a first absorbent member defining a first end surface, with the first end surface of the first absorbent member forming a first end of the cigarette filter subassembly. A second absorbent member defines a second end surface, with the second end surface of the second absorbent member forming a second end of the cigarette filter subassembly. At least, one capsule is provided between the first absorbent member and the second absorbent member with the at least one capsule containing a fluid material for modifying characteristics of tobacco smoke during smoking of the cigarette. The at least one capsule releases at least a portion of the fluid material when the at least one capsule is subjected to external force. The cigarette filter subassembly has an outer cover extending substantially from the first end of the cigarette filter subassembly to the second end of the cigarette filter subassembly and encloses the at least one capsule. The outer cover is formed of a material which is substantially impermeable to the fluid material of the at least one capsule.

In a preferred embodiment, the first absorbent member is substantially cylindrical and the second absorbent member is substantially cylindrical and the material of the outer cover is cellophane. The first absorbent member is comprised of cellulose acetate and the second absorbent member is comprised of cellulose acetate.

In another preferred embodiment only one capsule is provided between the first absorbent member and the second absorbent member and the fluid material contained within the one capsule is a liquid. The first absorbent member is substantially cylindrical and the second absorbent member is substantially cylindrical and the first and second absorbent members are comprised of cellulose acetate with the material of the outer cover being cellophane.

In another preferred embodiment, an annular layer of cellulose acetate is provided about the outer cover of the cigarette filter subassembly. The annular layer of cellulose acetate is preferably steam set. A third absorbent member comprised of cellulose acetate is provided generally adjacent the first end of the cigarette filter subassembly. A fourth absorbent member comprised of cellulose acetate is provided generally adjacent the second end of the cigarette filter subassembly.

In another preferred embodiment, a sorbent, such as a quantity of activated carbon, is provided between the second end of the cigarette filter subassembly and the fourth absorbent member. A tobacco rod is provided generally adjacent the fourth absorbent member.

A preferred embodiment of a method for manufacturing cigarette filter subassemblies comprises the steps of: providing a series of absorbent members; providing at least one capsule between adjacent absorbent members with the at least one capsule containing a fluid material for modifying characteristics of tobacco smoke during smoking of the cigarette. The at least one capsule releases at least a portion of the fluid material when the at least one capsule is subjected to external force. The method further comprises the step of providing an outer cover about the series of absorbent members and the at least one capsule provided between adjacent absorbent members. The outer cover is formed of a material which is substantially impermeable to the fluid material of the at least one capsule.

In another preferred embodiment of the method, each of the absorbent members is substantially cylindrical and the material of the outer cover is cellophane. The absorbent members are comprised of cellulose acetate. Only one capsule is provided between the adjacent absorbent members and the fluid material contained within the one capsule is a liquid. An annular layer of cellulose acetate is provided about the outer cover of the cigarette filter subassembly and the annular layer of cellulose acetate is steam set.

In another preferred embodiment, the method further comprises the step of cutting every other absorbent member in the series of absorbent members substantially midway between adjacent capsules. The step of cutting provides dual subassemblies with each of the dual subassemblies comprising one half of a first absorbent member, a first capsule, a second absorbent member, a second capsule, and one half of a third absorbent member provided in series within the outer surface. The annular layer of cellulose acetate is provided about the outer surface.

In another preferred embodiment, the method further comprises the step of providing a series of additional absorbent members with one of the dual subassemblies being provided between adjacent additional absorbent members. Every other one of the series of additional absorbent members is cut substantially midway between adjacent dual subassemblies. The step of cutting provides quad subassemblies with each of the quad subassemblies comprising one half of a first additional absorbent member, a first dual subassembly, a second additional absorbent member, a second dual subassembly, and one half of a third additional absorbent member.

In another preferred embodiment, the method further comprises the steps of cutting each of the dual subassemblies midway between adjacent capsules and cutting each of the second additional absorbent members midway between adjacent dual subassemblies, whereby an individual cigarette filter subassembly is provided.

A tobacco rod is provided generally adjacent one end of the individual filter assembly either before or after the dual subassemblies are cut midway between adjacent capsules.

In another preferred embodiment, the method further comprises the step of providing a quantity of carbon between each of the additional absorbent members and the adjacent dual subassembly. Every other one of the series of additional absorbent members is cut substantially midway between adjacent dual subassemblies. The step of cutting provides quad subassemblies with each of the quad subassemblies comprising one half of a first additional absorbent member, a first quantity of carbon, a first dual subassembly, a second quantity of carbon, a second additional absorbent member, a third quantity of carbon, a second dual subassembly, a fourth quantity of carbon, and one half of a third additional absorbent member.

In another preferred embodiment, the method further comprises the steps of cutting each of the dual subassemblies midway between adjacent capsules and cutting each of the second additional absorbent members midway between adjacent dual subassemblies whereby an individual cigarette filter subassembly is provided. An additional absorbent member is provided between adjacent pairs of the individual cigarette filter subassemblies to form a dual cigarette filter assembly with a tobacco rod provided generally adjacent each end of the dual cigarette filter assembly. The additional absorbent member is cut substantially midway between the adjacent pairs of the individual cigarette filter subassemblies to form individual cigarettes. The tobacco rod may be provided generally adjacent one end of the individual filter assembly either before or after the dual cigarette filter assemblies are cut midway between adjacent capsules.

BRIEF DESCRIPTION OF THE DRAWING FIGURES

DETAILED DESCRIPTION

Figure 1:
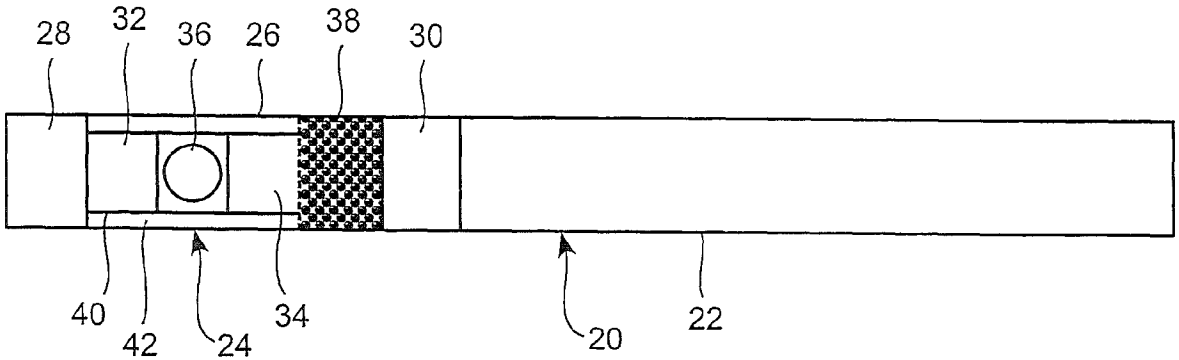
FIG. 1 is a cross-sectional view of a cigarette constructed in accordance with an embodiment.

A filter arrangement with an additive material, such as a flavor component, in a tobacco product, such as a cigarette, is provided. Improved delivery through controlled release of the additive material to cigarettes may be achieved through the use of one or more capsules, which are preferably sealed or frangible capsules, containing the additive material. This use of capsules allows for the core of the capsule to be controllably released by the smoker. This controlled release provided by the capsules can reduce reactivity between the additive material and the cigarette, can decrease evaporation and migration of the additive material within the cigarette, can allow for uniform or non-uniform distribution of the additive material, and/or can control the release of the additive material to achieve the proper timing until a predetermined stimulus and/or can allow for in situ mixing of additive materials.

The one or more capsules are preferably contained in the filter section of the cigarette, whereby the use of external force causes the one or more capsules to be mechanically opened prior to or during use of the cigarette. The opening of the one or more capsules allows the additive material to escape from the capsule(s) and interact with and modify the characteristics of the cigarette and thus the smoke derived therefrom. For example, the additive material may be used to provide one or more volatile flavor components to tobacco smoke passing through the filter or it may be used to provide a selective filtration compound (i.e., amine, etc.) which may have enhanced reactivity if presented in a wet state while it may require protection from drying and/or premature reaction with atmospheric components or light during storage.

A. Cigarettes

A cigarette typically contains two sections, a tobacco-containing portion sometimes referred to as the tobacco or cigarette rod, and a filter portion which may be referred to as a filter tipping. Tipping paper typically surrounds the filter, which forms the mouth end of the cigarette. The tipping paper overlaps with the tobacco rod in order to hold the filter and tobacco rod together. The tobacco rod, or tobacco containing element of the cigarette, includes the paper wrapper in which the tobacco is wrapped and the adhesive holding the seams of the paper wrapper together. The tobacco rod has a first end which is integrally attached to the filter and a second end which is lit or heated for smoking the tobacco. When the tobacco rod is lit or heated for smoking, the smoke travels from the lit end downstream to the filter end of the tobacco rod and further downstream through the filter.

The filter can be used with traditional cigarettes and non-traditional cigarettes. Non-traditional cigarettes include, for example, cigarettes for electrical smoking systems as described in commonly-assigned U.S. Pat. Nos. 6,026,820; 5,988,176; 5,915,387; 5,692,526; 5,692,525; 5,666,976; and 5,499,636, the disclosures of which are incorporated by reference herein in their entireties.

An exemplary embodiment of a method of making cigarettes comprises providing a cut filler to a cigarette-making machine to form a tobacco portion (e.g., a tobacco column); placing a paper wrapper around the tobacco column to form a tobacco rod; and attaching a filter portion to the tobacco rod to form the cigarette.

The term "mainstream smoke" includes the mixture of gases and/or aerosols passing down a cigarette, such as a tobacco rod, and issuing from an end, such as through the filter end, i.e., the amount of smoke issuing or drawn from the mouth end of a cigarette during smoking of the cigarette. The mainstream smoke contains air that is drawn in through the heated region of the cigarette and through the paper wrapper.

"Smoking" of a cigarette is intended to mean the heating, combusting or otherwise causing a release of certain chemicals from tobacco. Generally, smoking of a cigarette involves lighting one end of the cigarette and drawing the smoke downstream through the mouth end of the cigarette, while the tobacco contained therein undergoes combustion, pyrolysis or distillation of volatiles. However, the cigarette may also be smoked by other ways. For example, the cigarette may be smoked by heating the cigarette using an electrical heater, as described, for example, in commonly-assigned U.S. Pat. Nos. 6,053,176; 5,934,289; 5,591,368 or 5,322,075, each of which is incorporated herein by reference in its entirety.

B. Tobacco

Examples of suitable types of tobacco materials that may be used include, but are not limited to, flue-cured tobacco, Burley tobacco, Maryland tobacco, Oriental tobacco, rare tobacco, specialty tobacco, blends thereof and the like. The tobacco material may be provided in any suitable form, including, but not limited to, tobacco lamina, processed tobacco materials, such as volume expanded or puffed tobacco, processed tobacco stems, such as cut-rolled or cut-puffed stems, reconstituted tobacco materials, blends thereof, and the like. Tobacco substitutes may also be used.

In traditional cigarette manufacture, the tobacco is normally used in the form of cut filler, i.e., in the form of shreds or strands cut into widths ranging from about 1/10 inch to about 1/20 inch or even about 1/40 inch. The lengths of the strands range from between about 0.25 inch to about 3.0 inches. The cigarettes may further comprise one or more flavors, or other suitable additives (e.g., burn additives, combustion modifying agents, coloring agents, binders, etc.).

C. Filters

The filter material of the filter may be any of the variety of fibrous materials suitable for use in tobacco smoke filter elements. Typical fibrous materials include cellulose acetate, polypropylene or paper. Preferably, the filter material will be cellulose acetate.

The filter of a cigarette may also include a sorbent such as sorbent particles. Preferably, the sorbent particles have a size of about 0.3 mm to about 0.85 mm or 20 to 50 mesh size to facilitate loading into cavities of cigarette filters so as to achieve a desirable filter pressure drop (resistance to draw). This applies to a situation where the sorbent fills a well defined cavity in the filter section. Sorbents can be used in other forms in cigarette filters, e.g., sorbent particles may be distributed in the filamentary tow and in that form may be used as different segment lengths in the filter to provide the desirable reduction in one or more mainstream gas phase constituents.

Various cigarette filter constructions may be used, in which one or more capsules may be incorporated. Exemplary filter structures that may be used include, but are not limited to, a mono filter, a dual filter, a triple filter, a single or multi cavity filter, a recessed filter, a free-flow filter, combinations thereof and the like. Mono filters typically contain cellulose acetate tow or cellulose paper materials. Pure mono cellulose filters or paper filters offer good tar and nicotine retention, and are highly degradable. Dual filters typically comprise a cellulose acetate mouth end and a pure cellulose or cellulose acetate segment. The length and pressure drop of the segments in a dual filter may be adjusted to provide optimal sorption, while maintaining acceptable draw resistance. Triple filters may include mouth side and smoking material or tobacco side segments, and a middle segment comprising paper. Cavity filters include at least two segments, e.g., acetate-acetate, acetate-paper or paper-paper, separated by at least one cavity. Recessed filters include an open cavity on the mouth side. The filters may also be ventilated and/or comprise additional sorbents, catalysts or other additives suitable for use in the cigarette filter.

A filter region of an exemplary embodiment of a cigarette may be constructed with an upstream sorbent and a downstream capsule. A sorbent, for example, activated carbon, can be located in a cavity at a distance from one or more capsules, which can be located in a second section or portion of a filter spaced from the sorbent. Such arrangement would allow for the filtration of the cigarette to be accomplished by the sorbent, and for the flavor to be disposed within the cigarette without the effectiveness of the flavor being affected by absorption or adsorption by the sorbent.

D. Sorbents

As used herein, the term "sorption" denotes filtration by adsorption and/or absorption. Sorption is intended to encompass interactions on the outer surface of the sorbent, as well as interactions within the pores and channels of the sorbent. In other words, a "sorbent" is a substance that may condense or hold molecules of other substances on its surface, and/or take up other substances, i.e., through penetration of the other substances into its inner structure, or into its pores.

As used herein, the term "sorbent" refers to an adsorbent, an absorbent, or a substance that may perform both of these functions.

As used herein, the term "remove" refers to adsorption and/or absorption of at least some portion of a constituent of mainstream tobacco smoke.

While any suitable material may be used as a sorbent, preferred embodiments include activated carbon sorbents or microporous materials. The sorbent may be any material which has the ability to absorb and/or adsorb gas constituents on the surface thereof or to assimilate such constituents into the body thereof. If desired, the sorbent can incorporate catalyst material therein. By way of example, sorbent materials may include, but are not limited to, carbons such as activated carbon, aluminas, silicates, molecular sieves, and zeolites and may be used alone or in combination. In a preferred embodiment, the sorbent material is activated carbon.

Microporous materials (i.e., microporous sorbents) such as, for example, an activated carbon can be used to filter out gas constituents from cigarette smoke. The microporous sorbent may have pores with widths or diameters of less than about 20 Å.

While microporous materials are useful for filtering cigarette smoke,' microporous materials may also hinder a cigarette designer's ability to add volatile flavor components like menthol, for example. In particular, microporous sorbents tend to adsorb and/or absorb the flavor components during the time between cigarette manufacture and use by the consumer, thus reducing the effectiveness of the flavor components in the cigarette.

In addition to the reduction of the effectiveness of the flavor components due to the adsorption/absorption by the microporous sorbents, two additional problems are also encountered when the flavor component migrates to and is adsorbed/absorbed by the sorbent. First, the flavor component may occupy active sites in the sorbent; thereby reducing the sorbent's ability to remove targeted gas phase constituents from smoke. Second, because the flavor component is often strongly adsorbed/absorbed by the sorbent, the flavor component may not be sufficiently releasable. As such, separation between the microporous materials and the flavor components, or other additives is desired.

Another advantage of the controlled release of encapsulated volatile flavors in the filter is that encapsulated volatile additives are added to the smoke stream through the filter portion.

E. Additives

The term "additive" means any material or component which modifies the characteristics of a cigarette when the cigarette is smoked. Any appropriate additive material or combination of materials may be contained inside the one or more capsules to modify the characteristics of the cigarette. Such additive materials include flavors, neutralizing agents, and other smoke modifiers, such as chemical reagents like 3-aminopropylsilyl (APS) which interacts with smoke constituents. Additionally, the additive materials may also include diluents, solvents or processing aids that may or may not impact the sensorial attributes of the mainstream smoke but aid in processing of an additive and its encapsulation and presentation in a cigarette.

In a preferred embodiment, the additive materials may include one or more flavors, such as liquid or solid flavors and flavor formulations or flavor-containing materials. The term "flavor" or "tobacco flavor" may include any flavor compound or tobacco extract suitable for being releasably disposed in liquid form within one or more capsules such as one-piece capsules, two-part capsules, macrocapsules or microcapsules to enhance the taste of mainstream smoke produced, for example, by a cigarette.

Suitable flavors or flavorings include, but are not limited to, menthol, mint, such as peppermint and spearmint, chocolate, licorice, citrus and other fruit flavors, gamma octalactone, vanillin, ethyl vanillin, breath freshener flavors, spice flavors such as cinnamon, methyl salicylate, linalool, bergamot oil, geranium oil, lemon oil, ginger oil, and tobacco flavor. Other suitable flavors may include flavor compounds selected from the group consisting of an acid, an alcohol, an ester, an aldehyde, a ketone, a pyrazine, combinations or blends thereof and the like. Suitable flavor compounds may be selected, for example, from the group consisting of phenylacetic acid, solanone, megastigmatrienone, 2-heptanone, benzylalcohol, cis-3-hexenyl acetate, valeric acid, valeric aldehyde, ester, terpene, sesquiterpene, nootkatone, maltol, damascenone, pyrazine, lactone, anethole, iso-valeric acid, combinations thereof and the like.

In one embodiment, the additive material may serve as a chemical reagent for one or more constituents of mainstream smoke. Such an additive material may include, by way of example, a chemical additive which interacts with the one or more constituents in mainstream smoke. For example, see commonly assigned U.S. Pat. Nos. 6,209,547 and 6,595,218, which discuss reagents which can interact with and can remove gaseous constituents of a smoke stream, and are expressly incorporated herein by reference in their entireties.

F. Capsules

The capsules in the filter arrangement provide advantages particularly for cigarettes containing activated carbon. By placing the sealed capsules in the filter downstream from activated carbon in cigarettes containing activated carbon in the filter, adsorption of released additive material by the activated carbon and consequent deactivation of the carbon is substantially prevented. Thus, where the additive material is a flavor component, flavor adsorption by the activated carbon during storage of cigarettes and during smoking is substantially prevented.

By incorporating the additive material in one or more capsules in a filter, loss of flavor to side stream smoke is substantially reduced and less or none of the flavor component is pyrolyzed during the smoking of the cigarette. In addition, by positioning the one or more capsules containing the additive material in the filter section, the activated carbon can maintain its ability to modify cigarette smoke, which includes removing volatile organic components, such as 1,3-butadiene, acrolein, isoprene, etc., from mainstream smoke.

The term "releasably disposed" as used herein refers to the containment and release of additive materials in capsules such that the additive materials are sufficiently contained to substantially avoid or minimize unwanted migration, such as, for example, during storage. This term also includes, but is not limited to, the additive materials in the capsule being mobile enough to be released from the capsule when, for example, the capsule is broken or opened by mechanical force. For example, the capsule may be broken by squeezing a portion of a cigarette filter containing the capsule, thus releasing the additive material from within the capsule.

The capsule may be formed in a variety of physical formations including singular part or multipart capsules, large capsules, small capsules, microcapsules, etc. One preferred formation comprises a generally spherical capsule, while other preferred embodiments include macrocapsules or microcapsules. These preferred embodiments may include liquid additives and the additives may be released similarly by mechanical action. The capsules may be present in the filter section of a cigarette in a dispersed arrangement if small macrocapsules or microcapsules are provided, or may be present in a plug or cavity within a filter for one more capsules, preferably a single generally spherical capsule. However, the capsule or capsules are preferably present downstream from any sorbents in a cigarette, such as activated carbon.

The microcapsules may be formed by any suitable technique including encapsulation techniques, such as spin coating, coacervation, interfacial polymerization, solvent evaporation, annular jet forming, which uses two concentric jets to eject an inner jet of liquid core material and an outer jet of liquid wall material where the fluid stream breaks into droplets and the liquid wall material solidifies by phase transition induced by the presence of cross-linking ions, pH differences, temperature changes, etc.

Macrocapsules can be provided in a plug or cavity, and can be further encapsulated in a sheath or the like, or can be provided in a subassembly with an outer cover and one or more absorbent members if desired. By providing the macrocapsules in a sheath, within plug material, or within a subassembly with an outer cover and one or more absorbent members, the macrocapsules can be protected from accidental or incidental breakage or leakage, and the capsules can be made larger and weaker if desired.

Additionally, single wall or multi-wall capsules may be used to tailor capsule stability, strength, rupture resistance, processing ease in filter making, etc. The capsules may be made of any suitable material, such as those used in capsules for drug delivery, liquid encapsulated capsules, or other encapsulated materials. By way of example, capsules typically utilized in the pharmaceutical industry may be used. Such capsules may be gelatin based, for example, or may be formed from a polymeric material, such as modified cellulose. One type of modified cellulose which may be used is hydroxypropylmethyl cellulose.

G. Preferred Embodiments

With reference to FIG. 1, a cigarette 20 includes a tobacco rod 22 which is provided adjacent to a filter assembly 24. The filter assembly 24 includes a filter subassembly 26 having a first absorbent member 32 and a second absorbent member 34 with a capsule 36 provided between the first and second absorbent members 32, 34. A third absorbent member 28 is provided on a first side of the filter subassembly 26 and a fourth absorbent member 30 is provided on a second side of the filter subassembly 26. A quantity of activated carbon 38 is provided between the fourth absorbent member 30 and the second end of the filter subassembly 26. The fourth absorbent member 30 may also contain a quantity of activated carbon 38 wherein the sorbent articles are distributed in the filamentary tow. In exemplary embodiments, absorbent members 32, 34, 28, 30 can be filter plugs including cellulose acetate plugs.

Figure 2:
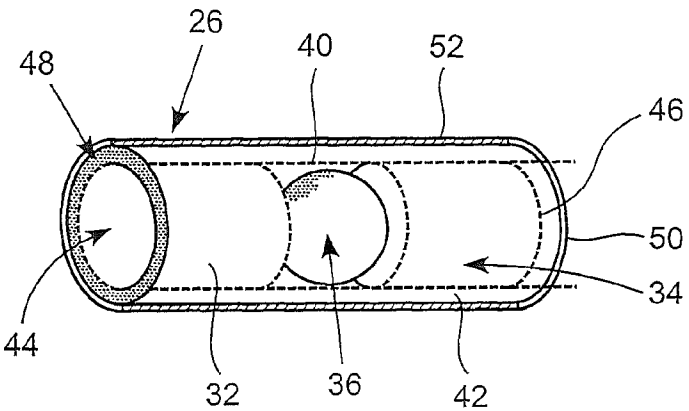
FIG. 2 is an illustration of a subassembly of a filter for a cigarette according to an embodiment.

With reference now to FIG. 2, the first absorbent member 32 is generally cylindrical in shape and defines a first end surface 44. The first end surface 44 of the first absorbent member 32 forms a first end 48 for the cigarette filter subassembly 26. The second absorbent member 34 is also generally cylindrical in shape and defines a second end surface 46. The second end surface 46 of the second absorbent member 34 forms a second end 50 of the cigarette filter subassembly 26. The first and second absorbent members 32, 34 are enclosed about their outer surface by a suitable, conventional plug wrap.

The capsule 36 is provided between the first absorbent member 32 and the second absorbent member 34. The capsule 36 contains an additive which is a fluid material for modifying characteristics of tobacco smoke during smoking of the cigarette 20. The capsule 36 releases at least a portion of the fluid material when the capsule 36 is subjected to external force, such as by squeezing by the smoker.

The cigarette filter subassembly 26 has an outer cover 40 for the first and second absorbent members 32, 34 and for the capsule 36 which extends substantially from the first end 48 of the cigarette filter subassembly 26 to the second end 50 of the cigarette filter subassembly 26. The outer cover 40 encloses the capsule 36. The outer cover is formed of a material which is substantially impermeable to the fluid material of the capsule 36. For example, the outer cover can be made of cellophane, polyvinylidene chloride, or other substantially impermeable film or sheet. By using a substantially impermeable material, staining of tipping paper can be reduced or eliminated upon release of the fluid material from the capsule. The outer cover 40 can partially or completely surround the cigarette filter subassembly 26 including the first and second absorbent members 32, 34 and the capsule 36. Additionally, the cigarette filter can be wrapped by one or more outer cover 40 layers as desired. For example, several layers may be desired for increased strength and/or rigidity.

In the preferred embodiment, the outer cover 40 is a layer of cellophane and the first and second absorbent members 32, 34 are comprised of cellulose acetate. Although in the preferred embodiment only a single capsule 36 is provided between the first and second absorbent members 32, 34, additional capsules 36 or a plurality of smaller capsules may be provided between the first and second absorbent members 32, 34.

Likewise, in the preferred embodiment, the capsule 36 is generally spherical with a substantially continuous outer shell enclosing a liquid within the shell. However, the one or more capsules in the filter subassembly 26 may be elonciated, such as oval shaped, or oblong or other than spherical and may be of multi-piece construction. Similarly, although in the preferred embodiment, the material within the capsule is a liquid, the material may be a non-liquid fluid.

An annular layer 42 of cellulose acetate is provided about the outer cover 40 of the cigarette filter subassembly 26 and the annular layer of cellulose acetate is steam set. A plug wrap 52 may be provided about the annular layer 42 of cellulose acetate.

The outer cover 40 prevents wicking of the material from the capsule (after the capsule has been squeezed by the user) in the radial direction of the cigarette through, for example, wrap and tipping paper which surround the capsule and the other filter components. The outer cover 40 thus reduces or entirely prevents staining of the tipping paper.

In a preferred embodiment, when the capsule 36 is broken, the liquid released from the capsule wicks axially and wets the first and second absorbent members 32, 34 of cellulose acetate. In exemplary embodiments, absorbent members 32, 34 can include highly wettable portions to aid in moving flavorant through the length of the absorbent members. For example, wicking material, such as an absorbent thread, can be provided and aligned axially, preferably centered within the absorbent members 32, 34, to axially carry and distribute liquid released by the one or more capsules within a cigarette filter subassembly 26. Preferably, the wicking material is more absorbent than the absorbent members such that liquid released from the capsules will be more readily absorbed by the wicking material.

Mainstream smoke can then flow from the tobacco rod through subassembly 26 first through the second absorbent member 34 (and the wicking material, if provided) and then through the first absorbent member 32 (and the wicking material, if provided), wherein the absorbent members 32, 34 can be wet by the liquid from the capsule. Additionally, dilution air may flow through the steam set cellulose acetate annular layer or overwrap. The two flows can be adjusted by adjusting the cellulose acetate filtration efficiency, through the use of dilution holes, etc. The liquid within the capsule is prevented from migration prior to breaking of the capsule (as by squeezing the filter prior to smoking). The capsule is suitable for use with cigarettes that include an activated carbon in the filter. The capsule may contain flavor components and may also contain components that facilitate selective filtration of the mainstream smoke and which are also released prior to smoking of the cigarette.

The steam set cellulose acetate annular layer 42 and the first and second absorbent members 32, 34 can be adjusted in size, density and composition to achieve different levels of dilution, resistance to flow and delivery.

In an exemplary embodiment, one or more capsules 36 with diameters of about 4-5 mm, preferably about 4.5-4.7 mm, are enclosed between two absorbent members 32, 34, which are wrapped in a cellophane outer cover 40 to form a cigarette filter subassembly 26, or "inner core" with an outer circumference of about 16-19 mm, preferably 17-18 mm. This inner core 26 is then wrapped in an annular layer 42 or "outer sheath," wherein the circumference of the outer sheath is about 24-25 mm, preferably about 24.4-24.5 mm, which in turn can be wrapped in plug wrap 52. Additionally, after wrapping in plug wrap 52, ventilation holes can be provided in the plug wrap 52 at a distance of about 10-15 mm, preferably about 12-13 mm, from a mouth end of a filter.

Figure 3:
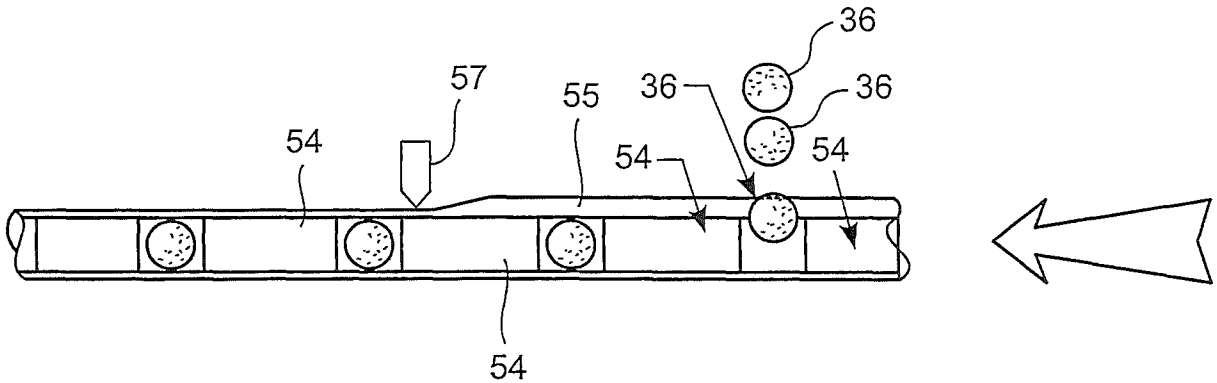
FIG. 3 is a side schematic view of a portion of an arrangement for making the subassembly of FIG. 2.

With reference now to FIG. 3, a portion of an arrangement for manufacturing the cigarette filter subassemblies 26 is schematically illustrated. During manufacture, a series of absorbent members 54 of cellulose acetate are provided. The absorbent members 54 are generally cylindrical in shape and have a diameter of about 5 mm and a length of about 10 mm. Each of the absorbent members 54 is preferably twice as long as each of the first absorbent member 32 and the second absorbent member 34 because each absorbent member 54 will eventually be cut to form a first absorbent member 32 and a second absorbent member 34. Of course, if the first absorbent member 32 and the second absorbent member 34 have different lengths, each of the absorbent members 54 preferably has a length corresponding to the combined length of a first absorbent member 32 and a second absorbent member 34. In addition, each of the members 54 may consist of two different compositions in terms of filamentary tow denier and density to yield members 54 with different absorption characteristics.

Figure 4:
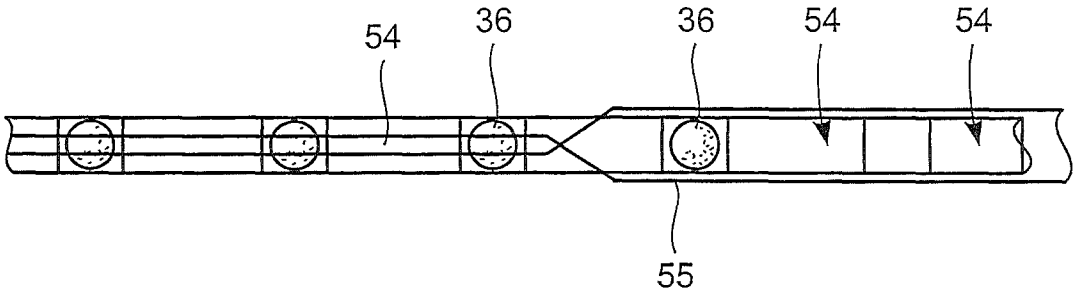
FIG. 4 is a top schematic view of the portion of an arrangement of FIG. 3.

The absorbent members 54 are conveyed along an assembly line with a predetermined spacing provided between adjacent ones of the absorbent members 54. A layer of impermeable material such as cellophane 55 which will eventually form the outer cover 40 is provided in a U-shaped manner about the bottom and sides of the absorbent members 54, see also FIG. 4. The U-shaped configuration of the layer of cellophane 55 enables the capsules to be inserted or dropped as by gravity into the spacing provided between adjacent ones of the absorbent members 54. After the capsules 36 have been provided between the adjacent absorbent members 54, a bead of hot melt adhesive is applied from a dispenser or applicator 57 to the lap seam formed when the sides of the layer of cellophane are overlaid one on top of the other to seal the ends of the cellophane together.

In the preferred embodiment, one capsule 36 is provided between each pair of adjacent absorbent members 54. However, if more than one capsule or if a quantity of microcapsules are to be provided between adjacent ones of the absorbent members 54, then the appropriate number of capsules (microcapsules or macrocapsules) are provided and the layer of cellophane is then overlaid and the ends are sealed together.

Although in the preferred embodiment, a layer of cellophane 55 provides the outer cover 40, other materials which are suitable for use in cigarettes and which are sufficiently impermeable to the fluid contained within the capsules may be used. However, the cost, and the ability to glue or seal the ends of the layer together should be considered. For example, the outer cover 40 may be provided by a suitable layer of a thermoplastic film such as polypropylene or polyethylene, etc. using an appropriate gluing or adhesive mechanism, such as heat sealing, as will be apparent to one skilled in the art. Likewise, the outer cover 40 may be provided by arrangements other than through the use of a U-shaped channel. For example, it may be possible to circumferentially wrap a layer of material around the first and second absorbent members 32, 34 and the intermediate capsule or capsules 36.

Figure 5:
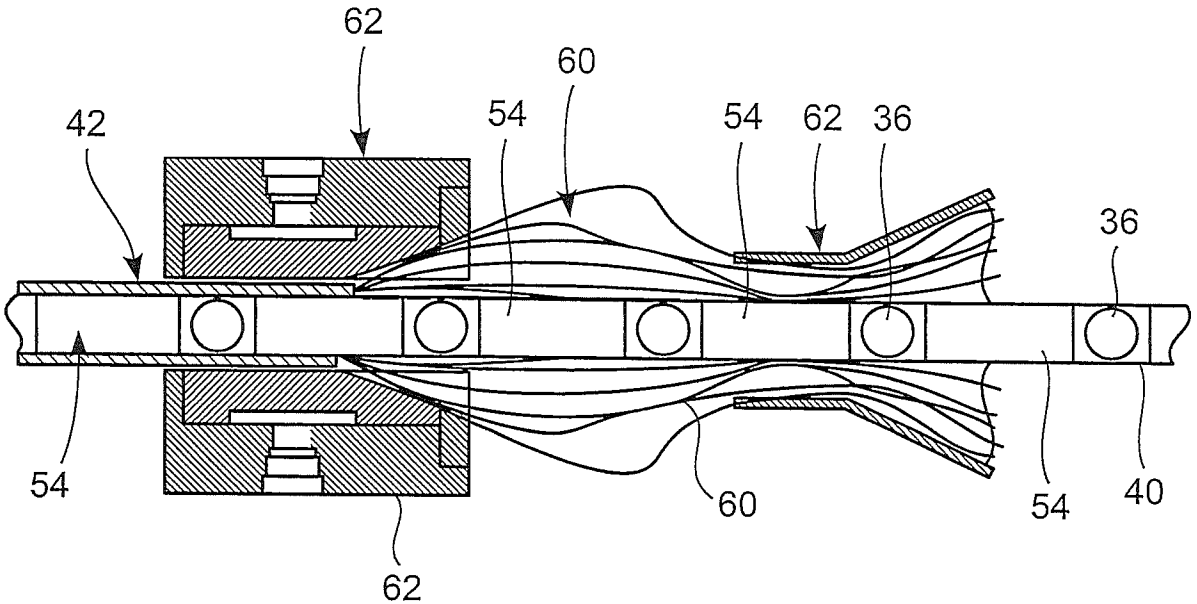
FIG. 5 is a schematic view of another portion of an arrangement for making the subassembly of FIG. 2.

With reference now to FIG. 5, the series of absorbent members 54 and the capsules 36 provided within the outer cover 40 are supplied to a stuffer jet 62. A filamentary tow 60 of cellulose acetate is provided around the outer cover 40 through the stuffer jet 62. The series of absorbent members 54 with the intermediate capsules 36 and the outer cover 40 is then fed through a steam head 62 to steam set the cellulose acetate filamentary tow into the annular layer 42 surrounding the outer cover 40. A plug wrap may then be provided about the outer surface of the annular layer 42. The disclosure of U.S. Pat. No. 4,064,791 which discloses an arrangement for forming the annular layer of steam set cellulose acetate is hereby incorporated by reference in the entirety for all purposes.

Figure 6:
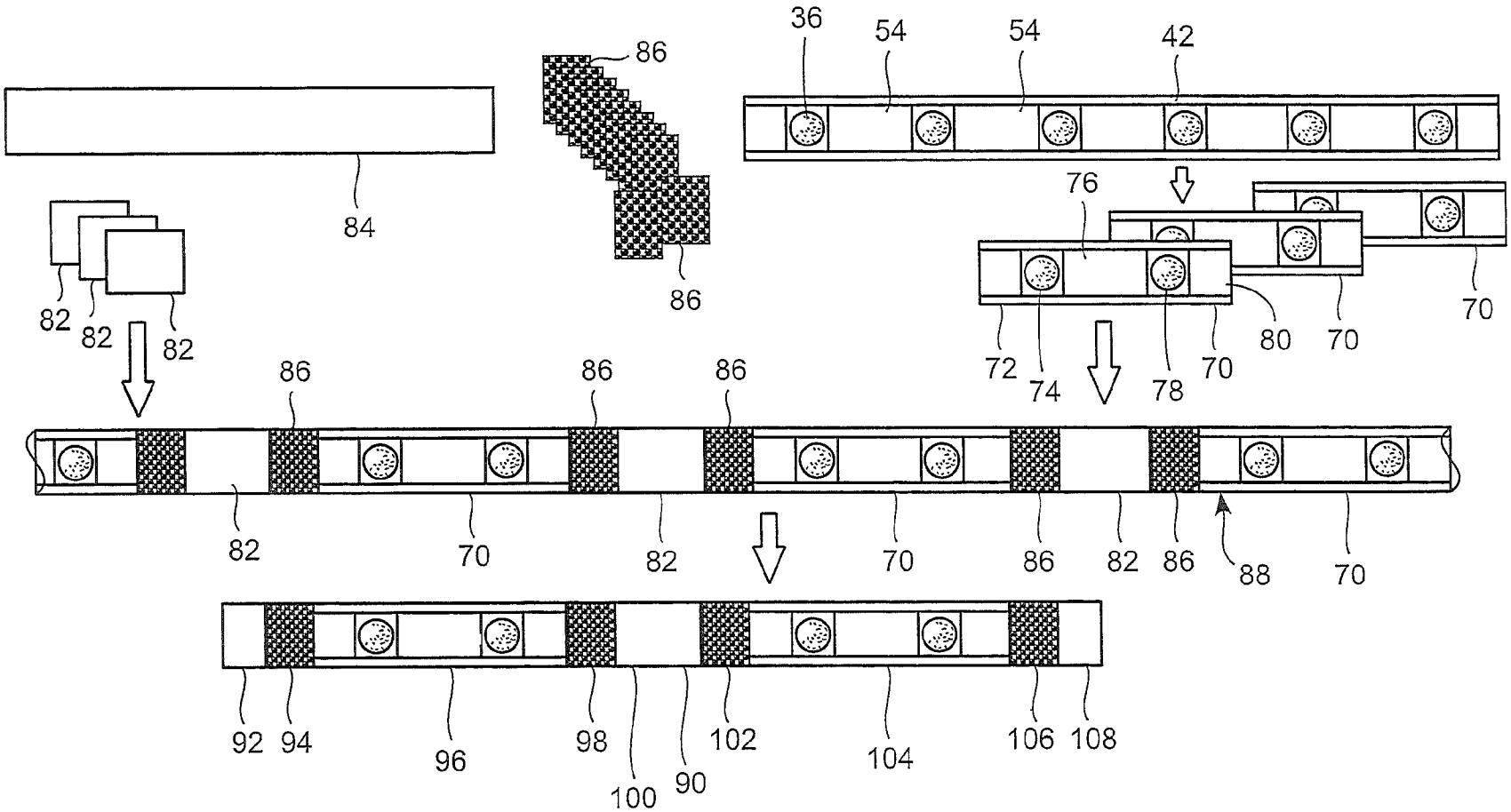
FIG. 6 is a schematic view of intermediate steps in the manufacture of cigarettes using the subassembly of FIG. 2.

With reference now to FIG. 6, the series of the absorbent members 54, the intermediate capsules 36, the outer cover 40 of cellophane and the annular layer 42 of cellulose acetate (and any plug wraps) is cut into dual subassemblies 70. The dual subassemblies 70 are formed by cutting every other absorbent member 54 in the series of absorbent members 54 substantially midway between adjacent capsules.

Each of the dual subassemblies 70 comprises one half of a first absorbent member 72, a first capsule 74, a second absorbent member 76, a second capsule 78, and one half of a third absorbent member 80 provided in series within the outer cover 40 and the annular layer 42 of cellulose acetate provided about the outer cover 40 of cellophane.

With continued reference to FIG. 6, a series of dual subassemblies 70 are then arranged with additional absorbent members 82 provided between adjacent dual subassemblies 70. The additional absorbent members 82 are formed of cellulose acetate by cutting a filter rod 84 into the additional absorbent members 82. The filter rod 84 may be enclosed within a plug wrap. Each of the additional absorbent members 82 is preferably long enough to form two of the fourth absorbent members 30 of the subassembly 26 (see, FIG. 1). In addition, a predetermined quantity of activated carbon 86 is provided between each of the additional absorbent members 82 and the adjacent dual subassemblies 70. In this way, a quantity of activated carbon 86 is provided on both sides of each of the additional absorbent members 82.

The series of additional absorbent members 82, the quantities of activated carbon 86, and the dual subassemblies 70 are enclosed within a plug wrap 88 as conventionally known in the manufacture of multi-component cigarette filters.

In the preferred method of manufacture, every other one of the series of additional absorbent members is cut substantially midway between adjacent dual subassemblies 70. The step of cutting provides a series of quad subassemblies 90. Each of the quad subassemblies 90 comprises one half of a first additional absorbent member 92, a first quantity of activated carbon 94, a first dual subassembly 96, a second quantity of activated carbon 98, a second additional absorbent member 100, a third quantity of activated carbon 102, a second dual subassembly 104, a fourth quantity of activated carbon 106, and one half of a third additional absorbent member 108.

Figure 7:
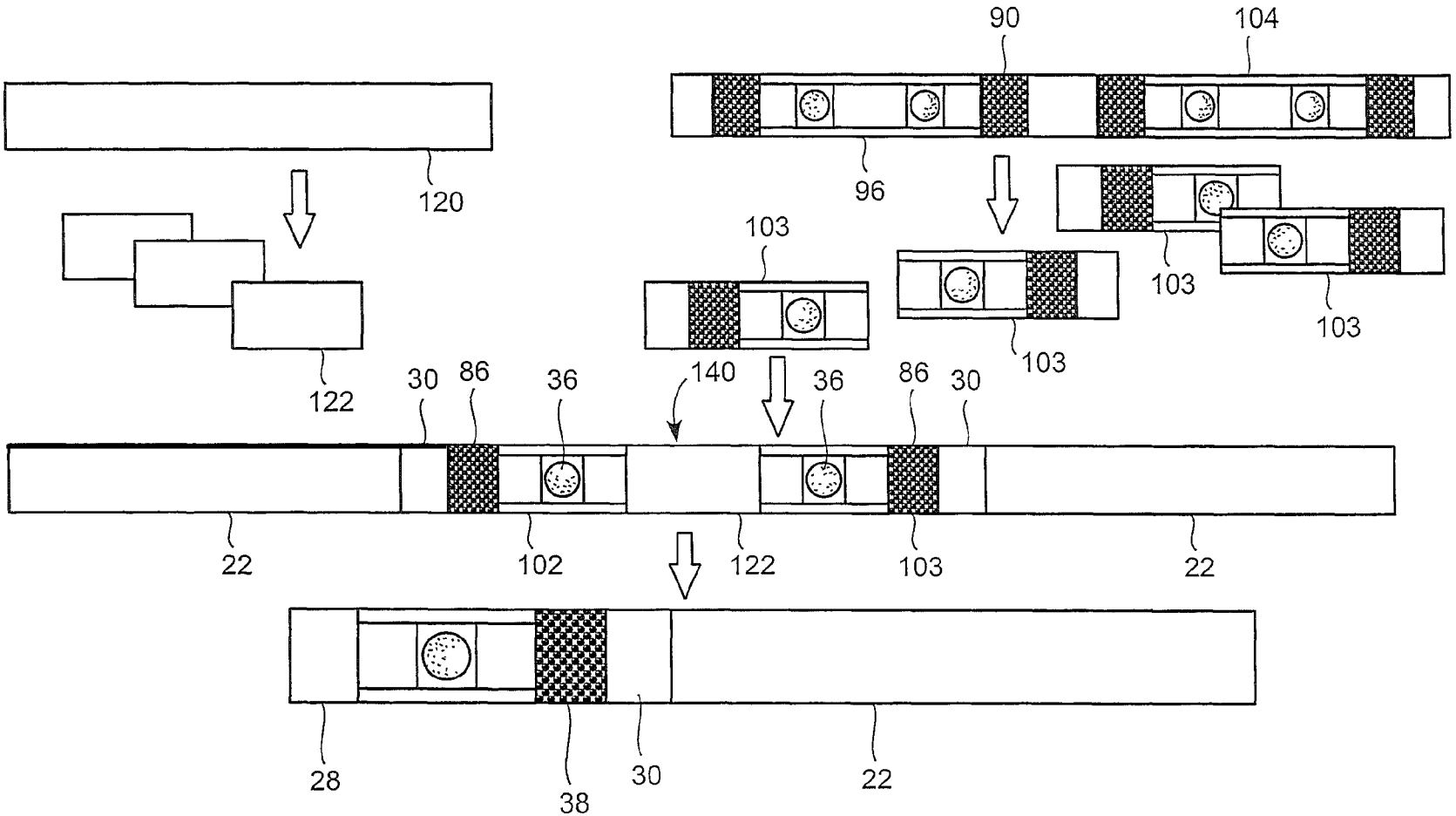
FIG. 7 is a schematic view of subsequent steps in the manufacture of cigarettes using the subassembly of FIG. 2.

With reference now to FIG. 7, in the preferred method of manufacture, each of the quad subassemblies 90 is cut into individual cigarette filter subassemblies 103. During manufacture, the first dual subassembly 96 is cut midway between adjacent capsules and the second dual subassembly 104 is cut midway between adjacent capsules to form the individual filter subassemblies 103. Subsequently, a cellulose filter rod 120 is cut into additional absorbent members 122 and one of the additional absorbent members 122 is arranged between two of the individual filter subassemblies 103. The individual filter subassemblies 103 are oriented so that the capsule 36 is located between the quantity of activated carbon 86 and the additional absorbent member 122.

The two individual filter subassemblies 103 and the additional absorbent member 122 provide a dual cigarette filter assembly 140. Typically, at this time a tobacco rod 22 is attached to each end of the dual cigarette filter assembly 140 with the tobacco rods provided adjacent to the fourth absorbent members 30 of the cigarette filter subassembly 24 (see also FIG. 1). The tobacco rod and the filter assemblies may be provided with appropriate plug wraps and tipping wraps, as desired. Subsequently, the additional absorbent members 122 are cut in half to form the third absorbent members 28 of the cigarette filter assembly and to form two cigarettes, each with an individual cigarette filter assembly.

If desired, the quantity of activated carbon 38 may be reduced or even omitted, in which case the fourth absorbent member 30 may be provided adjacent to the second end of the cigarette filter subassembly 24. If the quantity of activated carbon 38 is omitted and the fourth absorbent member 30 is provided directly adjacent to the second end of the cigarette filter subassembly 24, this fourth absorbent member 30 may have activated carbon or other sorbent articles distributed in the filamentary tow. Alternatively, if the quantity of activated carbon 38 is omitted, the fourth absorbent member 30 may also be omitted from the cigarette 20. In addition, the third absorbent member 28 may be omitted from the cigarette 20.

With reference again to FIG. 1, the orientation of the cigarette filter assembly 24 with respect to the tobacco rod 22 could be reversed so that the capsule 36 is provided between the tobacco rod 22 and the quantity of activated carbon 38 or a quantity of another sorbent. Depending upon the contents of the capsule 36, it may be preferable to have the capsule upstream rather than downstream of the sorbent.

The capsule 36 is preferably spherical with a diameter of about 4.5-4.7 mm with the diameter of the cylindrical first and second absorbent members 32, 34 being about 5 mm. In this way, air may flow around the capsule through a passageway provided by the outer cover 40 extending between the first and the second absorbent members 32, 34. The capsule preferably has a frangible wall which encapsulates the additive material. The frangible wall breaks to expose the additive material when the capsule is subjected to external force.

If desired, the capsule used to contain the additive material may be a two-part capsule, and may include a primary reservoir for additive material, where the additive material may be present in any form suitable for release from the capsule. By way of example, the primary reservoir may be completely or partially filled with a fluid additive or additives and/or may contain: a porous compressive material such as a sponge saturated with additive(s), or non-adsorbing solids to decrease the space available for the additive(s) or even additive-containing microcapsules to protect them from possible premature rupture during the rigor of filter making. Preferably, walls of the one or more capsules protect the additive material from migration and allow for controlled release of the additive material.

In a two-part capsule, the two parts may seal and/or lock the additive material within a primary reservoir and prevent leakage of the additive material prior to intended release by mechanical action. The capsule may include two parts which lock or fit sealingly into place and then at least partially separate by application of an external force allowing for release of liquid or vapor from a contained additive material from within the two-part capsule. The seal formed by the two parts can be a mechanical seal. However, to improve seal quality a banded seal may be provided externally to the capsules at the point where the two capsule parts come together. The bands may be made out of gelatin, hydroxypropylmethyl (HPMC) or other suitable materials, preferably a material similar to the material used to form the capsules.

In order to release the contained additive material from the capsules, preferably an external force, such as a mechanical action, is applied. One preferable method of applying the external force would be to have a user squeeze or exert an external force on a filter containing the capsule prior to or during the smoking of the cigarette. The squeezing action or application of external force preferably would break the capsule or at least partially deform a primary reservoir, which in turn would cause a displacement of mechanically locked or sealed in place internal components of the capsule. This displacement would then create one or more open spaces between internal components through which at least a portion of the additive material may be released from the capsule, e.g., liquid and/or vapor can be released from the capsule to modify the tobacco smoke passing through the filter. The acting force can be in a direction along or across the cigarette axis. Torsion may also be applied. An external device, such as a pinching device, a tube squeezing device, tweezers or any other device for applying torsion or compression forces, may also be used to concentrate the force at a prescribed filter location repeatedly.

In a two part capsule, the two parts may physically separate rather than rupture upon being squeezed by the user, in order to provide for a relatively predictable result. However, rupture may also be used as rupturing the capsule would also result in creating open spaces through which at least a portion of the additive material may be released from the capsule.

In a unitary capsule, flavor solutions may be encapsulated within a singular-part, seamless capsule. In an exemplary embodiment, microcapsules may be provided in a cigarette filter, where the microcapsules include additive materials therein. Similarly, macrocapsules and microcapsules may be ruptured by applying force, wherein the macrocapsules and microcapsules are ruptured to release additive materials therein.

It is noted that the terms "capsules" or "macrocapsules" are intended to define large capsules, preferably equal to or larger than about 1 mm in diameter, while the term "microcapsules" are defined as smaller capsules, preferably smaller than 1 mm.

A preferred cigarette would include a tobacco rod integrally attached to a filter, where the filter would include a filter subassembly having at least one capsule containing an additive material for modifying the characteristics of the cigarette smoke.

Preferably, a cigarette filter is arranged with the one or more capsules placed downstream from a sorbent material with filter material between the one or more capsules and the sorbent material or at the mouth end of the filter with one or more capsules placed between the mouth end of the filter or between the filter and the mouth end of the filter.

Also, a double capsule can be used herein. Preferably, a double capsule may be formed by a smaller capsule inside a larger one. These two capsules may contain materials or formulations that may or may not be compatible with each other. Double capsules, such as the DuoCap™ by Encap Drug Delivery of W. Lothian, Scotland can be used to hold the additive(s).

The quantity of activated carbon 38 provides a sorbent for the cigarette. The capsule 36 may be opened by a user of the cigarette squeezing the filter in the area of the capsule 36, causing deformation and/or breaking or opening of the capsule 36, thus releasing the additive and exposing the additive to mainstream smoke passing through the filter.

Preferably, the capsule 36 has a burst strength of about 0.5-0.8, 0.8-1.2, 1.2-1.6, 1.6-2.0 or 2.0-2.4 kilograms force (kgf).

In another embodiment, the capsule can be in the form of one or more microcapsules which encapsulate additive(s). Each microcapsule may be used alone or in combination with other microcapsules. When used in a cigarette, each microcapsule can contain the same or different additives from other microcapsule(s) in the cigarette (if present) depending upon the additive(s) desired. For example, a combination of ten menthol flavored microcapsules and five tobacco flavored microcapsules can be incorporated into a cigarette filter to provide a preferred menthol-tobacco combination of flavors.

Typically, the amount of additive used per cigarette may be extremely small since the additive is substantially sealed in the capsules during packaging and storing of the cigarette. By way of example, when a flavor is used as the additive, a few drops, e.g., 3-6, 6-9, 9-12 microliters, of flavoring may be sufficient in microcapsules, or more drops, e.g., 6-9, 9-12, or 12-15 or more microliters, may be sufficient in a two-part capsule or a microcapsule to provide an appropriate amount of flavor to the mainstream smoke when the cigarette is smoked.

The viscosity of the additive may also be controlled to allow for controlled wicking of the additive into the absorbent members 32, 34 formed of cellulose acetate. The outer cover 40 of, for example, cellophane, prevents the additive from staining the outermost layers of the filter of a cigarette, such as the tipping paper. Viscosity modifiers that could be used can include beeswax or other waxes for hydrophobic formulations and modified cellulosics, etc. for hydrophilic formulations.

The capsules may be of any size suitable for use in a cigarette, e.g., less than 2 mm, 2-3 mm, 3-4 mm, 4-5 mm or greater than 5 mm, and subassemblies containing capsules can vary in length depending on the length of the filter, e.g., less than 8 mm, 8-10 mm, 10-12 mm, or more than 12 mm. For traditional cigarettes, a capsule is preferably about 4-5 mm in diameter.

It is noted that the sorbent can also be incorporated into tow material for the filter. For example, activated carbon can be included within folds of a filter's tow material or within the bulk of the tow material, wherein the tow material forms a filter component of a cigarette.

To form generally spherical flavor capsules, a concentric nozzle can be used to co-extrude capsules having a flavor core and shell, the core being formed by a center passage of the concentric nozzle and, the shell being formed by an outer passage of the concentric nozzle. The capsule formed at the end of the concentric nozzle can be dropped into a solution, where gelation can occur. By co-extruding a liquid center flavor core and a shell wall outer layer, a capsule can be formed with a liquid center and a gelled shell wall thus providing a structural containment for a liquid additive. Alternatively, single extrusion may also be used to produce capsules.

Preferably, the flavor capsules may be made containing flavor cores, which may be hydrophobic such as mint oil, menthol or other additives as mentioned above, and outer layers, such as shell walls composed of natural polysaccharides or of both natural and modified polysaccharides, but may also be a polymer or other shell wall materials. Preferred polysaccharides include pectin, alginate, carageenan, gums and agar. Preferred polymers include proteins like gelatin, modified cellulosics or synthetic polymers such as derivatives of polyacrylates.

Single extrusion to form capsules may also be possible. For example, a hydrophobic flavor can be dispersed within a solution of hydrophilic polysaccharide and the dispersion can be extruded through a single nozzle into a water-based cation solution suitable for cross-linking of the polysaccharide. By allowing separation of the hydrophobic flavor from the hydrophilic components of the system (the polysaccharide and the cation), a distinct hydrophobic core can be formed in a capsule.

For example, a single extrusion to form capsules can be accomplished by mixing a mixture of 1.1 g of a menthol/mint flavor formulation in a vial containing 5 ml LM20 (amidated low methoxy pectin with 20% methoxy content) pectin solution of 5% by weight in water. The vial can then be vigorously shaken to produce a dispersion of the flavor in the pectin solution. The dispersion can then be extruded through a syringe needle drop-wise into a calcium chloride solution under constant agitation. As a result, capsules of about 1-2 mm in size can be formed instantly as the drops impact the solution to crosslink the pectin by the calcium cations. The capsules can then be harvested and air dried. By using a Scanning Electron Microscopy (SEM) to investigate cross sections of capsules formed from the above exemplary methodology, it can be seen that the capsules can be formed with distinct core and shell geometries and with a non-uniform dispersion of the menthol/mint flavor formulation. Similarly, another mixture can also be formed containing 2.2 g of glycerol, 0.3 g of the menthol/mint flavor formulation and 1.5 g of the 5% LM20 pectin solution. Capsules from this mixture can similarly be formed by precipitation in calcium chloride solution and can result in a core-shell type geometry similar to the other capsules.

The thickness of the outer layer may be controlled through nozzle design, where the ratio and size of flavor core and the outer layer can be specifically chosen. Alternatively, the thickness of the outer layer may also be controlled through specific selection of an outer layer material and the solution used to gel the outer layer material, where the outer layer material and the solution may react quickly or slowly and therefore form thicker or thinner shell wall outer layers depending upon the speed of their reaction with the solution.

The flavor core, as mentioned above, is preferably a hydrophobic flavor, but may also be a hydrophilic flavor. If a hydrophilic flavor is desired, however, the outer layer material properties are preferably different from those used with hydrophobic flavors. Additionally, the flavor core can also be a dispersion of hydrophilic and hydrophobic components, where preferably the hydrophilic component contains cations which can affect an outer region of the outer layer. The thickness may also be controlled through overcoating the primary capsule by additional ionic gelation encapsulation or other means.

Additionally, additives may be used to control the toughness, thermal stability, capsule functionality, etc. For example, cross-linking additives and humectants can be used to control the toughness of the shell wall outer layers, while surfactants may be used to control hydrophilic/hydrophobic interfaces between the flavor core and the shell wall outer layer or between the shell wall outer layer and the solution.

While the invention has been described in detail with reference to specific embodiments thereof, it will be apparent to one skilled in the art that various changes and modification may be made, and equivalents thereof employed, without departing from the scope of the claims.

The invention claimed is:

1. A cigarette filter subassembly, comprising:

a first absorbent member defining a first end surface, said first end surface of said first absorbent member forming a first end of said cigarette filter subassembly;

a second absorbent member defining a second end surface, said second end surface of said second absorbent member forming a second end of said cigarette filter subassembly;

at least one capsule provided between said first absorbent member and said second absorbent member, said at least one capsule containing a fluid material for modifying characteristics of tobacco smoke during smoking of the cigarette, said at least one capsule releasing at least a portion of the fluid material when the at least one capsule is subjected to external force;

said cigarette filter subassembly having an outer cover extending substantially from said first end of said cigarette filter subassembly to said second end of said cigarette filter subassembly and enclosing said at least one capsule, said outer cover being formed of a material which is substantially impermeable to said fluid material of said at least one capsule; and an annular layer of cellulose acetate provided about the outer cover of said cigarette filter subassembly, wherein said annular layer of cellulose acetate is steam set.

2. The cigarette filter subassembly of claim 1, wherein said:

first absorbent member is substantially cylindrical and said second absorbent member is substantially cylindrical; and/or material of said outer cover is comprised of cellophane or polyvinylidene chloride; and/or first absorbent member is comprised of cellulose acetate, and said second absorbent member is comprised of cellulose acetate; and/or at least one capsule consists of only one capsule provided between said first absorbent member and said second absorbent member; and/or fluid material contained within said one capsule is a liquid.

3. The cigarette filter subassembly of claim 1, further comprising:

a third absorbent member comprised of cellulose acetate, said third absorbent member being provided generally adjacent said first end of said cigarette filter subassembly; and/or a quantity of sorbent provided between said second end of said cigarette filter subassembly and said fourth absorbent member; and/or a wicking material within the first absorbent member and/or the second absorbent member, wherein the wicking material is more absorbent than the first absorbent member and/or the second absorbent member.

4. The cigarette filter subassembly of claim 1, further comprising:

a third absorbent member comprised of cellulose acetate, said third absorbent member being provided generally adjacent said first end of said cigarette filter subassembly; and/or a fourth absorbent member comprised of cellulose acetate, said fourth absorbent member being provided generally adjacent said second end of said cigarette filter subassembly; and/or a quantity of sorbent provided between said second end of said cigarette filter subassembly and said fourth absorbent member.

5. A cigarette comprising the cigarette filter subassembly of claim 1, further comprising a fourth absorbent member comprised of cellulose acetate, said fourth absorbent member being provided generally adjacent said second end of said cigarette filter subassembly, wherein a tobacco rod is provided generally adjacent said fourth absorbent member.

6. A dual subassembly formed by providing a series of absorbent members;

providing at least one capsule between adjacent absorbent members, said at least one capsule containing a fluid material for modifying characteristics of tobacco smoke during smoking of the cigarette, said at least one capsule releasing at least a portion of the fluid material when the at least one capsule is subjected to external force;

providing an outer cover about said series of absorbent members and said at least one capsule provided between adjacent absorbent members, said outer cover being formed of a material which is substantially impermeable to said fluid material of said at least one capsule;

providing an annular layer of cellulose acetate about the outer surface of said cigarette filter subassembly, said annular layer of cellulose acetate being steam set; and cutting every other absorbent member in said series of absorbent members substantially midway between adjacent capsules, said step of cutting providing dual subassemblies, each of said dual subassemblies comprising one half of a first absorbent member, a first capsule, a second absorbent member, a second capsule, and one half of a third absorbent member provided in series within said outer cover, with said annular layer of cellulose acetate provided about said outer cover.

7. A quad subassembly formed by providing a series of absorbent members;

providing at least one capsule between adjacent absorbent members, said at least one capsule containing a fluid material for modifying characteristics of tobacco smoke during smoking of the cigarette, said at least one capsule releasing at least a portion of the fluid material when the at least one capsule is subjected to external force;

providing an outer cover about said series of absorbent members and said at least one capsule provided between adjacent absorbent members, said outer cover being formed of a material which is substantially impermeable to said fluid material of said at least one capsule;

providing an annular layer of cellulose acetate about the outer surface of said cigarette filter subassembly, said annular layer of cellulose acetate being steam set;

cutting every other absorbent member in said series of absorbent members substantially midway between adjacent capsules, said step of cutting providing dual subassemblies, each of said dual subassemblies comprising one half of a first absorbent member, a first capsule, a second absorbent member, a second capsule, and one half of a third absorbent member provided in series within said outer cover, with said annular layer of cellulose acetate provided about said outer cover;

providing a series of additional absorbent members with one of said dual subassemblies being provided between adjacent additional absorbent members; and/or providing a quantity of activated carbon between each of said additional absorbent members and said adjacent dual subassembly;

cutting every other one of said series of additional absorbent members substantially midway between adjacent dual subassemblies, said step of cutting providing quad subassemblies;

each of said quad subassemblies comprising one half of a first additional absorbent member, a first dual subassembly, a second additional absorbent member, a second dual subassembly, and one half of a third additional absorbent member; or each of said quad subassemblies comprising one half of a first additional absorbent member, a first quantity of activated carbon, a first dual subassembly, a second quantity of activated carbon, a second additional absorbent member, a third quantity of activated carbon, a second dual subassembly, a fourth quantity of activated carbon, and one half of a third additional absorbent member.

8. A cigarette formed by providing a series of absorbent members;

providing at least one capsule between adjacent absorbent members, said at least one capsule containing a fluid material for modifying characteristics of tobacco smoke during smoking of the cigarette, said at least one capsule releasing at least a portion of the fluid material when the at least one capsule is subjected to external force;

providing an outer cover about said series of absorbent members and said at least one capsule provided between adjacent absorbent members, said outer cover being formed of a material which is substantially impermeable to said fluid material of said at least one capsule;

providing an annular layer of cellulose acetate about the outer surface of said cigarette filter subassembly, said annular layer of cellulose acetate being steam set;

cutting every other absorbent member in said series of absorbent members substantially midway between adjacent capsules, said step of cutting providing dual subassemblies, each of said dual subassemblies comprising one half of a first absorbent member, a first capsule, a second absorbent member, a second capsule, and one half of a third absorbent member provided in series within said outer cover, with said annular layer of cellulose acetate provided about said outer cover;

providing a series of additional absorbent members with one of said dual subassemblies being provided between adjacent additional absorbent members; and/or providing a quantity of activated carbon between each of said additional absorbent members and said adjacent dual subassembly;

cutting every other one of said series of additional absorbent members substantially midway between adjacent dual subassemblies, said step of cutting providing quad subassemblies;

each of said quad subassemblies comprising one half of a first additional absorbent member, a first dual subassembly, a second additional absorbent member, a second dual subassembly, and one half of a third additional absorbent member; or each of said quad subassemblies comprising one half of a first additional absorbent member, a first quantity of activated carbon, a first dual subassembly, a second quantity of activated carbon, a second additional absorbent member, a third quantity of activated carbon, a second dual subassembly, a fourth quantity of activated carbon, and one half of a third additional absorbent member;

cutting each of said dual subassemblies midway between adjacent capsules; and, cutting each of said second additional absorbent members midway between adjacent dual subassemblies, whereby an individual cigarette filter subassembly is provided;

providing an additional absorbent member between adjacent pairs of said individual cigarette filter subassemblies to form a dual cigarette filter assembly;

providing a tobacco rod generally adjacent each end of said dual cigarette filter assembly;

joining the tobacco rods to the dual cigarette filter assembly with tipping paper; and cutting said additional absorbent member substantially midway between said adjacent pairs of said individual cigarette filter subassemblies to form individual cigarettes.

* * * * *